United States Patent [19]

Sawada et al.

[11] Patent Number: 4,911,553

[45] Date of Patent: Mar. 27, 1990

[54] METHOD AND APPARATUS FOR FEEDING SOLID-LIQUID MIXTURE

[75] Inventors: Hiroshi Sawada, Neyagawa; Masayuki Nakatani, Nara; Hitoshi Iwata, Tsuzuki; Katsuaki Namba, Ikoma, all of Japan

[73] Assignee: House Food Industrial Co., Ltd., Japan

[21] Appl. No.: 125,441

[22] Filed: Nov. 25, 1987

[30] Foreign Application Priority Data

Nov. 28, 1986 [JP] Japan ..... 61-283925
Jun. 19, 1987 [JP] Japan ..... 62-153134

[51] Int. Cl.[4] ..... B01F 7/04; B01F 7/08; B01F 15/02; B65D 88/54

[52] U.S. Cl. ..... 366/186; 366/192; 366/193; 366/196; 366/318; 366/320; 366/325; 366/327; 222/282; 222/484

[58] Field of Search ..... 366/160, 184, 186, 189, 366/192, 193, 194–196, 241, 271, 279, 318, 320, 321, 325, 341, 327, 348, 349; 222/480, 484, 226, 236, 238, 239, 240, 242, 242, 282; 137/268; 53/502; 425/176–178, 239, 240

[56] References Cited

U.S. PATENT DOCUMENTS

| | | | |
|---|---|---|---|
| 38,167 | 4/1863 | Hungerford | 366/193 |
| 147,717 | 2/1874 | Warren | 366/186 |
| 201,410 | 3/1878 | Green | 366/325 |
| 935,506 | 9/1909 | Hueyboch | 53/502 |
| 1,345,657 | 7/1920 | Zeuthen et al. | 366/318 |
| 1,640,528 | 8/1927 | Bruhn | 222/480 |
| 2,320,469 | 6/1943 | Raomussen | 366/320 |
| 2,362,387 | 11/1944 | Lubwig | 222/480 |
| 2,383,536 | 8/1945 | Elliott | 425/239 |
| 2,957,203 | 10/1960 | Marshall, III | 366/184 |
| 3,029,069 | 4/1962 | Cummings . | |
| 3,148,866 | 9/1964 | Booth | 366/325 |
| 3,366,368 | 1/1968 | Hibbing | 366/160 |
| 3,374,989 | 3/1968 | Todtenhaupt | 366/325 |
| 3,516,220 | 6/1970 | Buford et al. | 53/502 |
| 3,524,730 | 8/1970 | Yokouchi et al. | 366/321 |
| 4,099,005 | 7/1978 | Fullington et al. . | |
| 4,519,529 | 5/1985 | Seltz | 222/484 |
| 4,695,167 | 9/1987 | Mori et al. | 366/189 |
| 4,712,922 | 12/1987 | Feterl | 366/186 |
| 4,830,507 | 5/1989 | Bogatto et al. | 366/349 |

FOREIGN PATENT DOCUMENTS

| | | | |
|---|---|---|---|
| 45593/79 | 10/1979 | Australia . | |
| 43385/85 | 12/1985 | Australia . | |
| 637290 | 10/1936 | Fed. Rep. of Germany | 222/484 |
| 826118 | 12/1951 | Fed. Rep. of Germany | 366/186 |
| 918010 | 9/1954 | Fed. Rep. of Germany | 222/484 |
| 575666 | 8/1924 | France | 226/107 |
| 714790 | 9/1954 | United Kingdom . | |
| 2091232 | 7/1982 | United Kingdom | 222/480 |
| 2094268 | 9/1982 | United Kingdom | 141/258 |
| 2146617A | 4/2485 | United Kingdom . | |

*Primary Examiner*—Harvey C. Hornsby
*Assistant Examiner*—Joseph S. Machuga
*Attorney, Agent, or Firm*—Mason, Fenwick & Lawrence

[57] ABSTRACT

A method for feeding a solid-liquid mixture comprised of a liquid and a solid having a specific gravity greater than that of the liquid comprising depositing the solid component around a feed opening disposed at the bottom of a mixing container and feeding the solid-liquid mixture to a container for packing the same through the opening is provided and the method can effectively be carried out utilizing an apparatus comprising a mixing container, a feed opening disposed at the bottom of the mixing container, a feed controlling device disposed below or within the feed opening and characterized in that it comprises a collecting device for depositing the solid component of the mixture around the feed opening. The present invention makes it possible to feed the solid-liquid mixture in a desired constant mixing ratio since the ratio can easily be controlled by simply depositing solid component around the feed opening and changing the cross-section of the flow path at any position from the feed opening to the chute member.

13 Claims, 11 Drawing Sheets

METHOD AND APPARATUS FOR FEEDING SOLID-LIQUID MIXTURE

BACKGROUND OF THE INVENTION

1. Field of the Invention

The present invention relates to a method for feeding a solid-liquid mixture and an apparatus therefor and more particular to a method adapted for feeding or dispensing a solid-liquid mixture such as stew, soup, curry and sauce into a container such as packing bags as well as an apparatus therefor.

2. Description of the Prior Art

Heretofore, apparatuses for feeding a solid-liquid mixture such as those listed above to a container in a desired mixing ratio and a constant amount have been known. For instance, there is known an apparatus in which a solid-liquid mixture is fed to a container while agitating the mixture with blades for agitation. However, in such an apparatus, particles of the solid component present in the mixture collide with each other due to the agitation as well as the blades collide with the solid particles. As a result, the solid particles suffer from damages and are destroyed and, moreover, bubbles are formed in the solid-liquid mixture depending on the rotational speed of the blades, which leads to lowering of the commercial value of the resultant goods and the reduction of the precision in the metring of the mixture during filling.

In addition, there is known another apparatus for feeding or dispensing a solid-liquid mixture into a container in a desired mixing ratio, in which the solid-liquid mixture is agitated by blowing air into the solid-liquid mixture. However, in this apparatus, it is difficult to avoid the solid component from causing collisions with each other, which leads to the destruction of the solid component and the formation of bubbles in the mixture becomes more severe problem as compared with the aforementioned apparatus provided with blades for agitation.

SUMMARY OF THE INVENTION

Under such circumstances, it has been expected to develop a method and an apparatus for feeding a solid-liquid mixture into a proper container in a desired amount and a constant mixing ratio, which do not suffer from the foregoing drawbacks associated with the conventional methods and apparatuses.

Accordingly, it is a primary object of the present invention to provide a simple method for feeding a solid-liquid mixture to a container, which surely avoids the solid component from being damaged and destroyed and which makes it possible to certainly control and maintain a desired mixing ratio between the solid and liquid components throughout the dispensing operations.

It is another object of the present invention to provide an apparatus for feeding a solid-liquid mixture into a proper container, which does not cause damages and destruction of the solid component and which permits the easy control and maintenance of the mixing ratio of the mixture.

It is still another object of the present invention to provide an apparatus for feeding a solid-liquid mixture to an apparatus for filling or dispensing the mixture into a proper container without causing the formation of bubbles in the mixture.

The aforementioned and other objects of the present invention can certainly be accomplished, on the one hand, by providing a method for feeding a mixture composed of at least one liquid component and at least one solid component having a specific gravity greater than that of the liquid into a container which comprises depositing the solid components present in the mixture in the vicinity of a feed opening disposed at the bottom of a container for mixing and feeding the solid component through the feed opening to a container such as packing bag. According to another aspect of the present invention, there is provided an apparatus for feeding such a mixture as that composed of at least one liquid and at least one solid component having a specific gravity greater than that of the liquid into a proper container in a desired mixing ratio and a constant amount, which can be adapted for carrying out the method for feeding the mixture according to the present invention and the apparatus is characterized in that it is provided with a collecting device for depositing the solid component in the vicinity of a feed opening for filling and dispensing the solid-liquid mixture into a container.

In addition, according to a specific embodiment of the present invention, the foregoing feed opening may be constituted so that the area of the opening can freely be changed.

BRIEF DESCRIPTION OF THE ATTACHED DRAWINGS

The present invention will hereunder be described in more detail with reference to the accompanying drawings, in which.

PREFERRED EMBODIMENTS OF THE INVENTION

Figure 1:
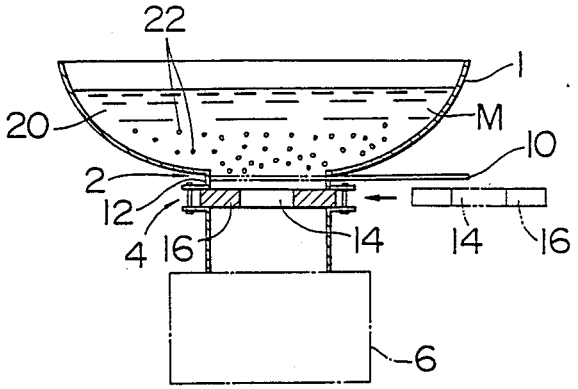
FIG. 1 is a sectional view for illustrating the first embodiment of the apparatus for carrying out the first example of the method of the present invention.

The first example of the method of this invention may be carried out using an apparatus shown in FIG. 1 illustrating the first embodiment thereof. As seen from FIG. 1, the apparatus comprises a bell shaped container 1 for mixing a solid-liquid mixture M, a feed and shut-off device 2 for feeding and shutting off the mixture contained in the container 1, which is disposed at the bottom of the container 1 and a feed controlling device 4 for adjusting the minimal sectional area of the path for feeding the mixture M therethrough and disposed below the feed and shut-off device 2, the feed controlling device 4 being connected to a known filling device 6. In this embodiment, the internal surface of the mixing container 1 is constituted by a part of a spheric surface, however, it is also possible to constitute the surface thereof by a member in the form of a reversed truncated cone provided with a feed and shut-off device 2 at its bottom.

The feed and shut-off device 2 comprises a shut-off plate 10 which is inserted in and withdrawn from a feed path 12. The feed controlling device 4 is constructed so that a plurality of plates 16 each having a through hole 14 of a different size, which are previously prepared, can be selectively inserted into the feed path 12 from one side of the feed path.

Using such an apparatus of the foregoing construction, a liquid component 20 is mixed with a solid component 22 of a specific gravity greater than that of the liquid in the mixing container and the solid component 22 is deposited on the bottom of the mixing container. At this stage, the shut-off plate 10 is withdrawn from the feed path 12 while inserting a selected plate 16 having an opening 14 of a desired size into the feed path 12. Thus, the liquid component 20 and the solid component 22 deposited on the bottom of the container 1 are transferred to a filling or dispensing device 6 through the feed path 12 while maintaining a desired mixing ratio of the mixture.

Other examples of the method according to the present invention will hereunder be explained However, these examples are explained simply on the basis of the mixing container 1 and the feed controlling device, and the explanation and the diagrammatic representation of the feed and shut-off device 2 and the filling or dispensing device 6 which are common to the apparatus shown in FIG. 1 and other apparatuses are omitted.

Figure 2:
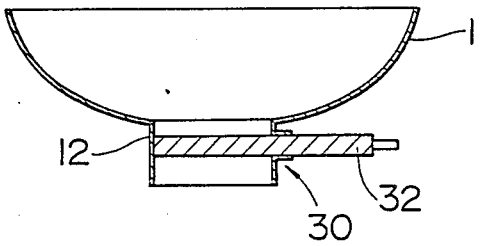
FIG. 2 is a sectional view for illustrating a part of the second embodiment of the apparatus used to carry out the second example of the method of the present invention.

The second example of the method according to the present invention may effectively be carried out utilizing an apparatus shown in FIG. 2. In this apparatus, a feed controlling device 30 is constructed so that the feed amount and the mixing ratio of the mixture M can be controlled by adjusting the position of the feed controlling plate 32 to be inserted into the feed path 12. The insertion of the feed controlling plate 32 into the path is achieved by the reciprocating motion or the rotational motion of the feed controlling plate 32 within a plane perpendicular to the feed path 12.

Figure 3:
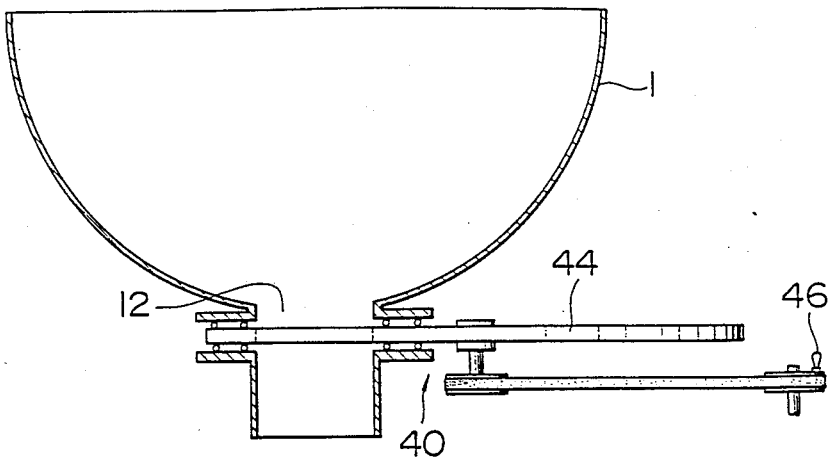
FIG. 3 is a sectional view for illustrating a part of the third embodiment of the apparatus used for carrying out the third example of the method according to the present invention.
Figure 4:
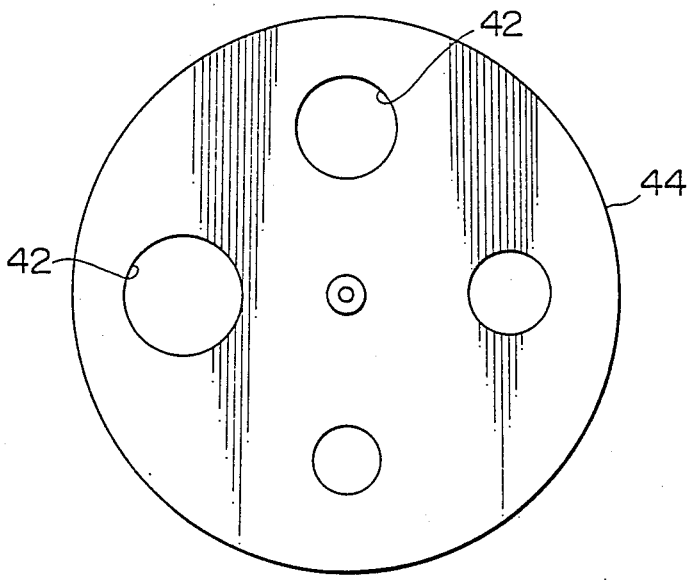
FIG. 4 is a schematic plan view of the apparatus shown in FIG. 3.

The third example of the method according to the present invention may likewise effectively be carried out utilizing an apparatus shown in FIGS. 3 and 4. In this apparatus, the feed controlling device 40 comprises a revolver 44 having a plurality of through holes 42 of different diameters, formed on the same circumference thereof and provided with a handle 46. In this respect, any one of the circular holes 42 may selectively be located within the feed path 12 by rotating the handle 46.

Figure 5:
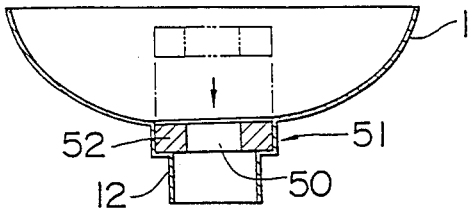
FIG. 5 is a sectional view for illustrating the fourth embodiment of the apparatus used for carrying out the fourth example of the method of the present invention.

The fourth example of the method according to the present invention may effectively be carried out using an apparatus shown in FIG. 5. In this apparatus, the feed controlling device 51 is constructed so that a plurality of plates 52 previously prepared, each having a through hole 50 of a different area, may selectively be inserted into the feed path 12 from the side of the mixing container 1. In this apparatus, it is desirable that the feed and shut-off device be placed below the feed controlling device 51.

Figure 6:
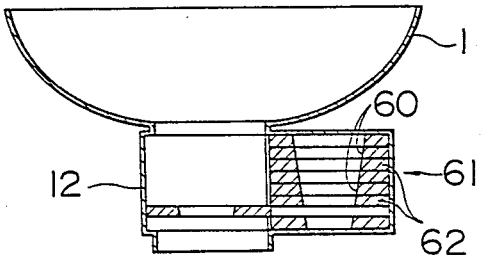
FIG. 6 is a sectional view for illustrating the fifth embodiment of the apparatus used for carrying out the fifth example of the method according to the present invention.

The fifth example of the method according to the present invention may be carried out using an apparatus shown in FIG. 6, wherein the feed controlling device 61 is provided with a plurality of plates 62 each having a through hole 60 of a different area, as in the apparatus used in the fourth embodiment. The plates having through holes are arranged at the side of the feed path 12 while they are superposed on one another and are constructed so that any one of them can be selectively inserted into the feed path 12.

Figure 7:
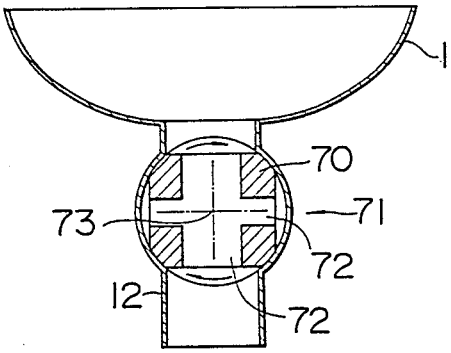
FIG. 7 is a sectional view for illustrating the sixth embodiment of the apparatus used for carrying out the sixth example of the method according to the present invention.

The sixth example of the method according to the invention may be carried out utilizing an apparatus shown in FIG. 7, wherein the feed controlling device 71 comprises a cylindrical member 70 having a plurality of circular through holes 72, each being perpendicular to the axial line 73 of the cylindrical member and which are formed within the same cross-section thereof. The cylindrical member is engaged with the feed path 12 so as to be able to freely rotate around the axial line 73. In this embodiment, the minimal cross section of the feed path 12 is determined by selecting any particular through hole 72 and arranging it so as to be parallel to the feed path 12.

The seventh example of the method according to the present invention may effectively be carried out with an apparatus in which the feed controlling device comprises a flexible tube constituting a part of the feed path and a variable clamping device disposed outside the flexible tube. In this embodiment, the mixing ratio of the mixture is controlled and/or adjusted by changing the size of the minimal cross section of the flexible tube for feeding the mixture therethrough, which is effected by operating the variable clamping device.

The eighth example of the method according to the present invention may be carried out with an apparatus wherein the feed controlling device comprises a variable throttling device like an aris located within the feed path. If the variable throttling device is one capable of complete shut-off of the feed path, the use of the feed and shut-off device may be omitted. In this embodiment, the mixing ratio may be controlled by adjusting the degree of throttling of the variable throttling device.

Figure 8:
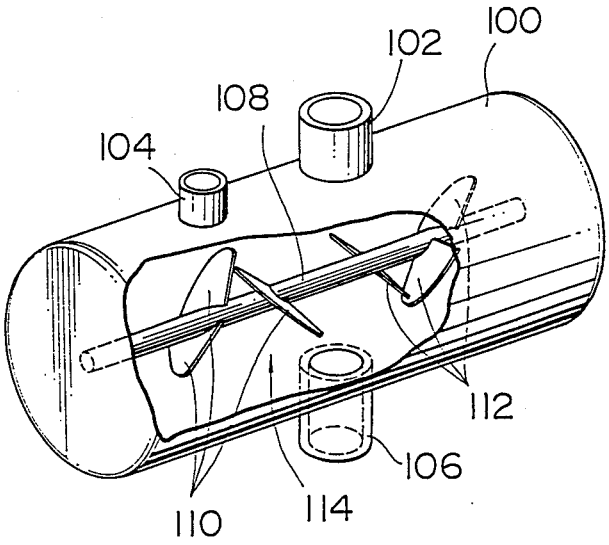
FIG. 8 is a sectional view for illustrating the ninth embodiment of the apparatus adapted for carrying out the ninth example of the method of the present invention.

The ninth example of the method according to the present invention may effectively be carried out with an apparatus shown in FIG. 8 wherein a cylindrical container 100 is installed horizontally. In this apparatus, there are disposed, on the upper side thereof, a solid-liquid inlet opening 102 for introducing a solid-liquid mixture into the cylindrical container 100 and a sight through window 104 for observing the interior of the container 100. On the other hand, there is disposed, on the lower side thereof, a solid-liquid outlet opening 106 for transferring the mixture, the outlet opening being communicated to the feed controlling device (not shown). Within the container 100, a rotary shaft 08 having an axis coinside with the axial line of the mixing container is placed and two groups of collecting blades 110 and 112, each comprising two blades, are disposed around the shaft symmetrically with respect to the center of the solid-liquid outlet opening 106. A collecting device 114 comprised of the rotary shaft 108 and the collecting blades 110 and 112 fixed around the shaft is rotated at a relatively low speed by the action of a driving device (not shown) and thus the solid component of the mixture deposited on the bottom of the container can be moved along the bottom surface of the container without any floating or flying about of the particles whereby the particles are collected on the solid-liquid outlet portion 106 or in the vicinity thereof.

TEST EXAMPLE

Using an apparatus having a construction almost similar to one used in the ninth example of the method of this invention, the variation in the mixing ratio of the charged solid-liquid mixture, in this case a mixture of water and soybean which has been immersed in water over night (the major axis=about 7 to 10 mm), was examined while selecting a circular hole of 76.2 mm in diameter as the minimal cross section of the feed controlling device, through which the mixture is transferred.

| Test No. 1 | |
|---|---|
| Solid-Liquid Ratio (by weight) in the Mixing Container | 56:44 |
| Net weight Charged (average) | 410.7 g |

| Test No. 2 | |
|---|---|
| Solid-Liquid Ratio (by weight) in the Mixing Container | 42:58 |
| Net weight Filled (average) | 404.5 g |

Figure 9:
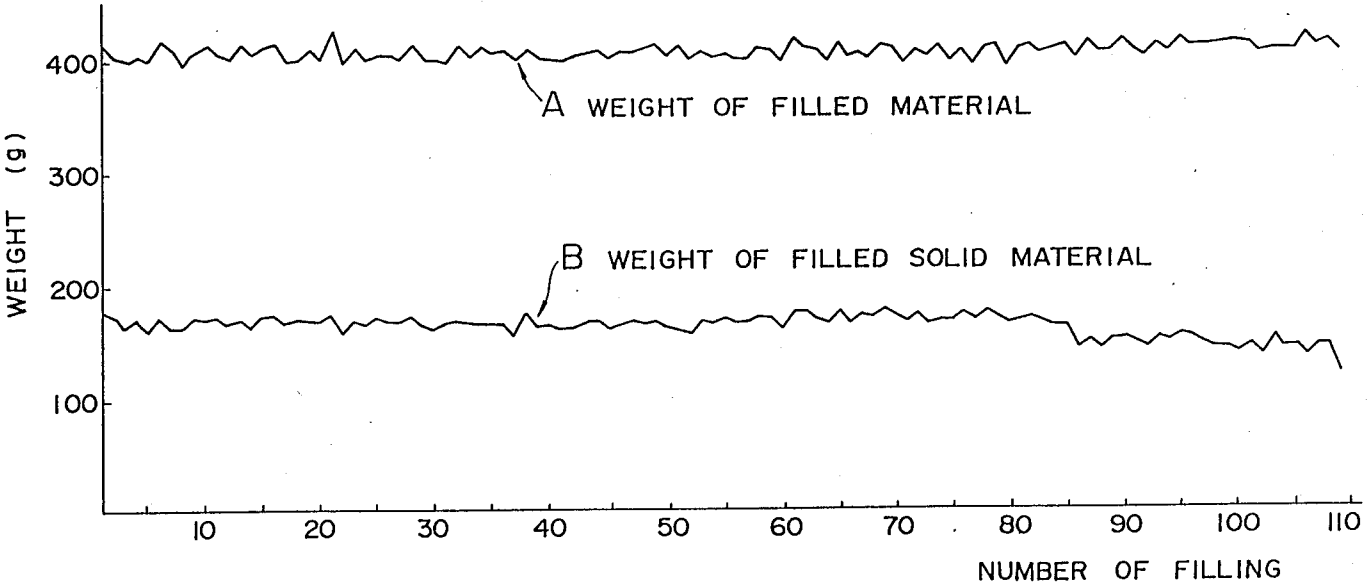
FIG. 9 is a graph showing the solid/liquid ratio observed in Test Example 1.
Figure 10:
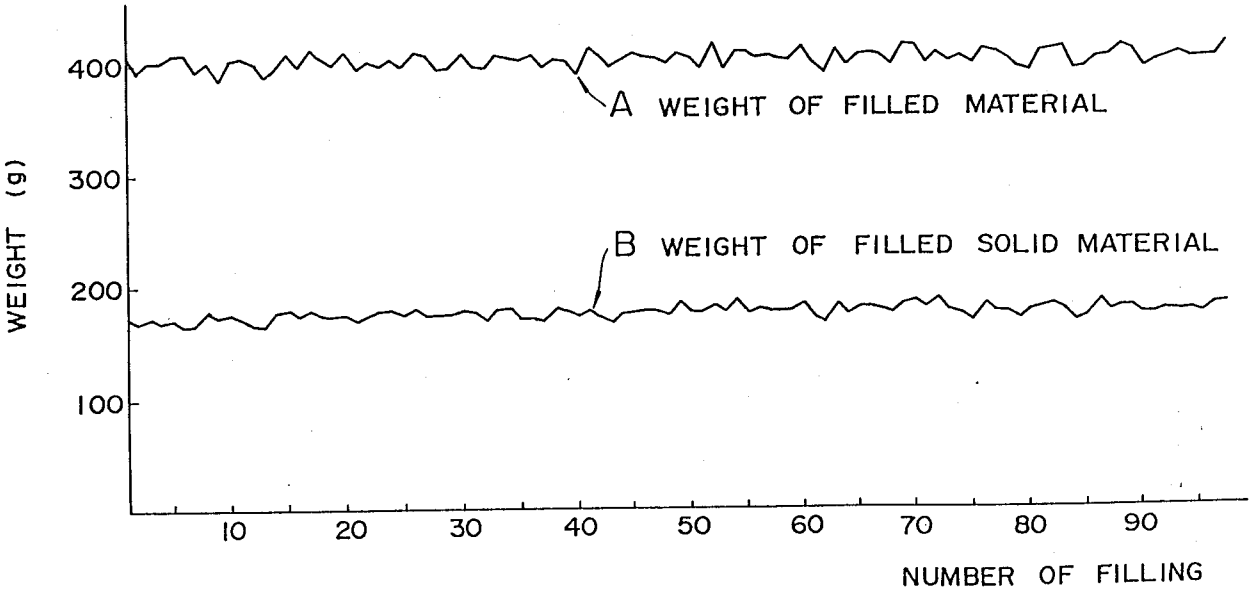
FIG. 10 is a graph showing the solid/liquid ratio observed in Test Example 2.

The results observed are shown in FIG. 10 according in the same manner as in FIG. 9.

The apparatuses for feeding a solid-liquid mixture to a filling device according to the present invention will hereunder be explained in more detail with reference to the accompanying drawings, FIGS. 11 to 19. In this respect, it should be noted that the apparatuses shown in FIGS. 1 to 8 and explained above associated with the examples of the method of this invention are also the very embodiments of the apparatus according to the present invention.

Figure 11:
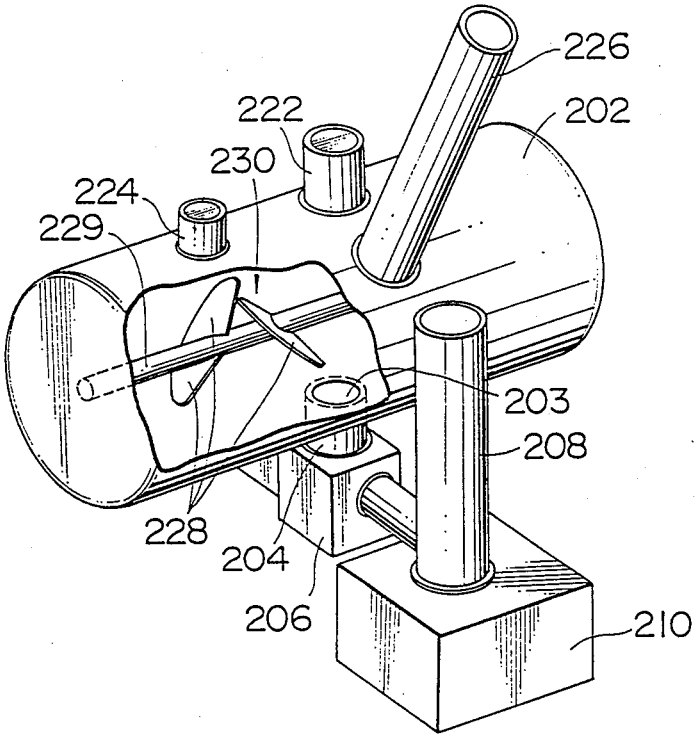
FIG. 11 is a perspective view of the apparatus for feeding solid-liquid mixtures according to the present invention.

The first embodiment of the apparatus according to the present invention comprises, as shown in FIG. 11, a mixing container 202 of approximately cylindrical shape, a chute member 204 mounted on a feed opening 203 portion disposed on the bottom of the mixing container 202, a first piston device 206 connected to the lower portion of the chute member 204, a second piston device 208 connected to the first piston device 206 at its one side and a filling or dispensing device 210.

The mixing container 202 is provided with, on the top thereof, a level gage 222 for determining the height of the liquid level of the solid-liquid mixture in the container and a sight through window 224 for observing the interior of the container therethrough, and, on the upper side thereof, a tube 226 for feeding the solid-liquid mixture into the mixing container.

Figure 12:
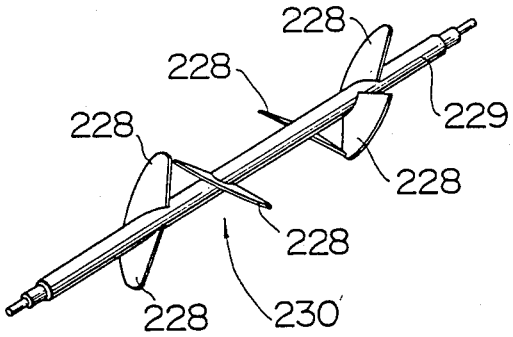
FIG. 12 is a perspective view of a collecting device used in the present invention.

As shown in FIGS. 11 and 12, a collecting device 230 is installed within the mixing container 202 and the device comprises a shaft member 229 on which four collecting blades 228 are disposed and planted perpendicular to the cylindrical side of the member. The shaft member 229 has an axis in common with the mixing container 202 and is disposed within the container in a freely rotatable manner, which is rotated by the operation of a driving device (not shown). The collecting blades 228 are divided into two groups each comprising too blades and these two groups of collecting blades are mounted on the shaft symmetrically with respect to the feed opening 203 so as to form spirals having orientations opposite to one another.

Figure 16:
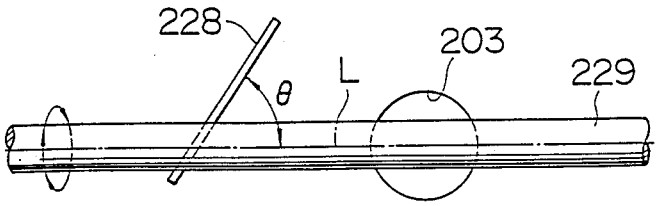
FIG. 16 is a schematic plan view of a collecting blade.

Each collecting blade 228, as shown in FIG. 16, is mounted on the shaft member 229 so as to satisfy the following requirement:

$$0^\circ < \theta < 90^\circ$$

wherein $\theta$ is an angle made between the axial line L and each one of the collecting blades 228 interested, in the anticlockwise direction with respect to the axial line L of the shaft member 229 when observing them just above the shaft member 229 in the hypothesises that the shaft member 229 is rotated in the clockwise direction upon observing it from the side of the feed opening 203 and the collecting blades 228 are situated just below the shaft member 229. The solid component of the mixture is gradually moved along the bottom surface of the mixing container 202 and transferred towards the feed opening 203 by arranging the collecting blades 228 in such a manner as described above.

Figure 17:
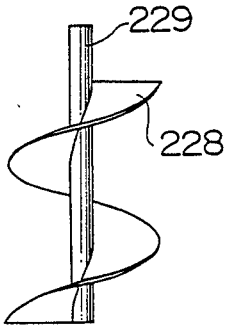
FIG. 17 is a side view o a screw type collecting blade.
Figure 18:
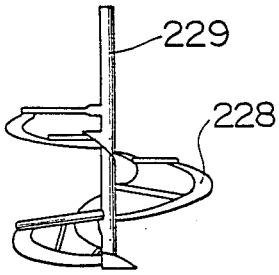
FIG. 18 is a side view of a ribbon-like collecting blade.
Figure 19:
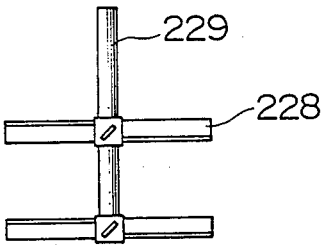
FIG. 19 is a side view of a paddle type collecting blade.

As desired examples for the construction of the collecting blades 228, there may be mentioned such a screw type one as shown in FIG. 17, such a ribbon type one as shown in FIG. 18 and such a paddle type one as shown in FIG. 19. The screw type collecting blade provides various advantages such that it can transfer the solid component to the filling device even if the rotational speed is substantially low and that it is possible to restrict the occurrence of the damages of the solid component since the blades, in this case, is comprised of a continuous one. If a ribbon type or paddle type collecting blade is used, it is required to increase the rotational speed thereof in order to achieve a desired movement or transfer of the solid component, however, these types of blades exhibit advantages that they may easily be processed to desired shapes and thus the manufacturing cost thereof is quite low. In the embodiment shown in FIG. 12, the collecting blades 228 are arranged along a spiral locus at equal intervals and thus they make it possible to transfer the solid component at an equal speed over the whole portion of the mixing container 202.

Moreover, it is desirable that the collecting blades 228 should not be mounted on the upper portion of the feed opening 203. This is because the deposits of the solid component are disturbed in the vicinity of the feed opening 203 due to the rotation of the collecting blades 228 and thus becomes unstable. However, if the chute member 204 of relatively depth is used, it is not necessary to restrict the region at which the collecting blades 228 are disposed since the solid components are always deposited on the chute member 204 stably.

The radius of the collecting blades 228 are determined so that the distance between the apex thereof and the internal surface of the mixing container 202 becomes as close as possible. This is required for preventing the fail of collection of the solid component by the collecting device 230.

The chute member 204 is in general formed in a cylindrical shape or a funnel like shape and it may integrally be formed together with the mixing container 202 as a part thereof. Furthermore, the collecting blades 228 are mounted on the shaft member 229 approximately perpendicular with respect to the latter and, therefore, the solid component is not paddled, by the collecting blades 228, towards the upper portion of the mixing container 202 and in turn the solid component is not damaged and destroyed due to the collisions therebetween.

Figure 13:
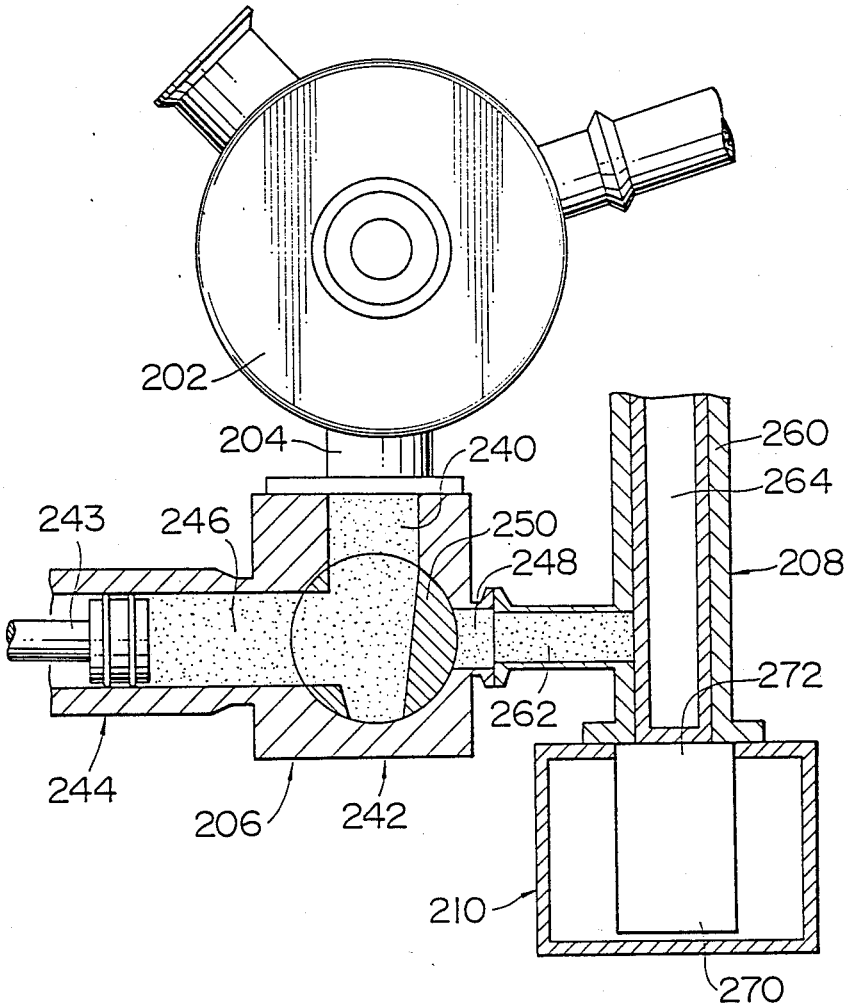
FIGS. 13 to 15 are diagrams for illustrating the functions of the first piston device and the second piston device.
Figure 14:
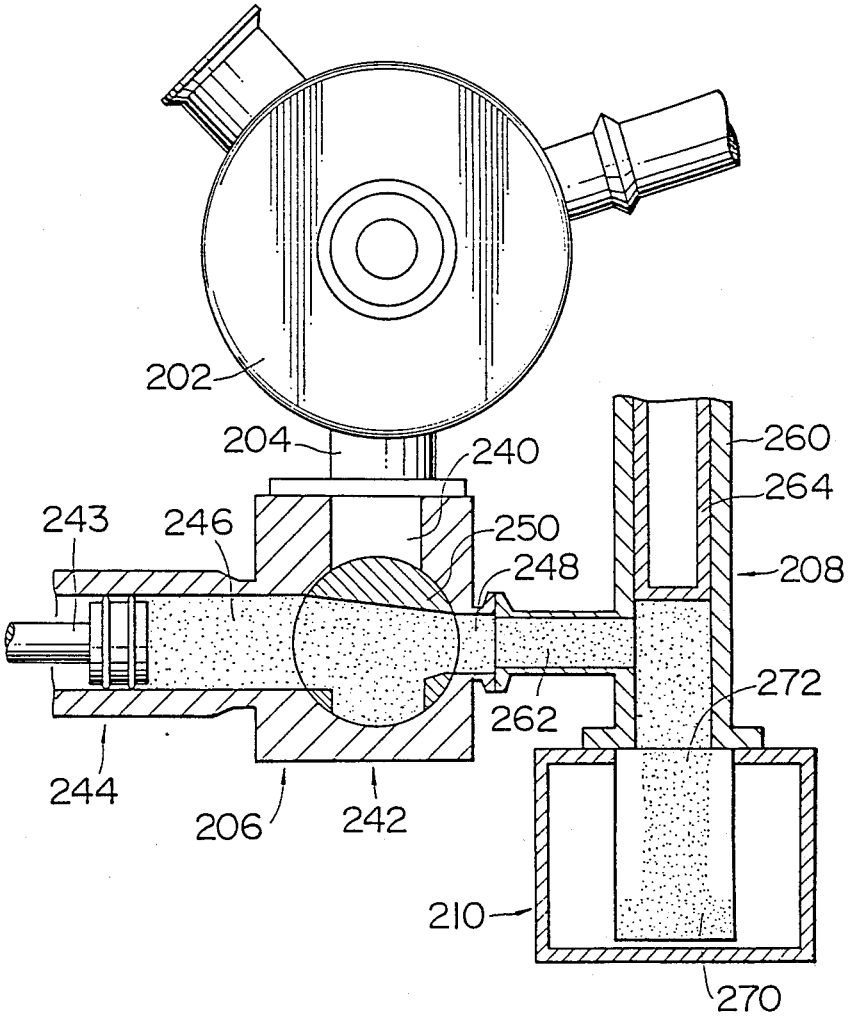
Figure 15:
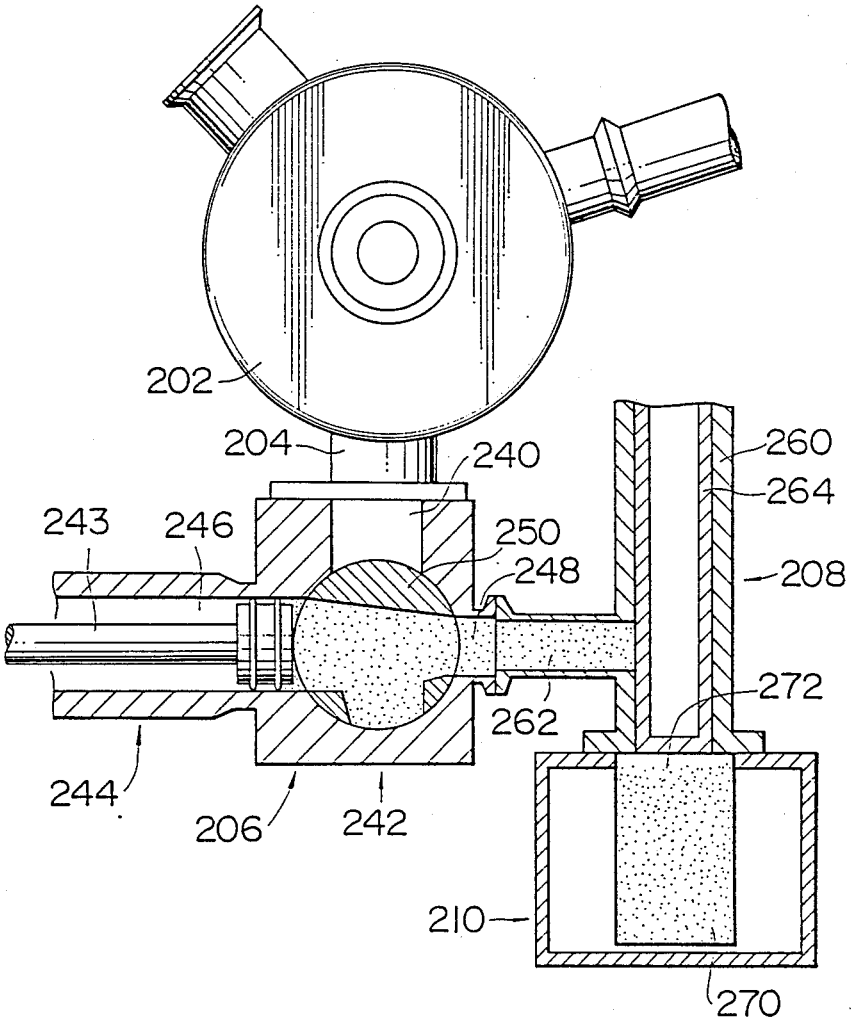

The first piston device 206 comprises, as shown in FIGS. 13 to 15, a device 242 for switching flow paths and a first piston 244 provided with a first piston member 243. The flow path switching device 242 is provided with inlet portion 240, a piston communicating portion 246 and a delivery portion 248, and there is disposed a switching member 250 at the communicating portion common to these three portions. The switching member 250 may be located at either the position at which the inlet portion 240 and the piston communicating portion 246 are communicated to one another, a shown in FIG. 13; or the position at which the piston communicating portion 246 and the delivery portion 248 are communicated to one another as shown in FIGS. 14 and 15.

The second piston device 208 comprises a cylinder 260 provided with a tube 262 for communicating the cylinder with the delivery portion 248 of the first piston device 206. The position at which the communicating tube 262 is connected to the cylinder 260 is determined so that the communicating tube 262 is opened to communicate the tube 262 with a filling device 210 when the second piston member 264 is situated at the upper portion as shown in FIG. 14 and that, on the other hand, it is closed when the second piston member 264 is situated at the lower portion as shown in FIGS. 13 and 15.

The filling device 210 fills, into packing bags 270, a desired amount of the solid-liquid mixture transferred from the second piston device 28 and then seals the opening 272 of the packing bag for finishing a cycle of the packing operation of the mixture.

Then, the function of the apparatus for supplying solid-liquid mixture having the foregoing construction will hereunder be explained. The solid-liquid mixture is introduced into the mixing container 202 through a tube 226 for filling the same. In the mixing container 2, the shaft member 229 is rotated at a relatively low speed to collect the solid material around the inlet portion of the chute member 204 and to deposit the solid material within the chute ember 204. The rotational speed is determined so that the solid material is not propelled up from the bottom of the container by the rotation of the shaft member 229 and it is slowly moved along the bottom surface and transferred towards the chute member 204.

On the other hand, as shown in FIG. 13, the piston member 243 of the first piston device 206 is moved back so that the inlet portion 240 and the piston communicating portion 246 are communicated to one another and a desired volume for receiving the material is assured, thereby the solid-liquid mixture being filled therein.

Subsequently, the switching member 250 is rotated so as to communicate the piston communicating portion 246 and the delivery portion 248, as shown in FIG. 14 and thus the first piston member 243 advances to transfer, under pressure, the solid-liquid mixture present in the first piston device 206 to the second piston device 208.

In the second piston device 208, as shown in FIG. 14, the second piston member 264 ascends to communicate the communicating pipe 262 with the packing bag 270 and thus a part of the solid-liquid mixture is packed into the packing bag 270. Then, the second piston member 264 descends so that the solid-liquid mixture present in the second piston device 208 is further packed in the packing bag 270 until a desired amount of the mixture is finally filled therein.

The aforementioned operations of the first and second piston devices 206 and 208 are repeated and on the other hand, the packing bags 270 are also continuously supplied one by one thereby the filling of the mixture into the packing bags being continuously effected.

In the embodiment of the apparatus having the foregoing construction, the adjustment of the mixing ratio of the solid-liquid mixture can be effected by selectively placing, between the chute member 204 and the inlet portion 240 in the device for switching the flow paths, a throttling plate selected from those having various openings of different sizes. Moreover, the adjustment of the mixing ratio of the solid-liquid mixture may also be effected by changing the cross-section of the flow path of the chute member 204, through which the solid material is transferred, or that of the opening 203 for feeding.

Thus, according to the method of the present invention which comprises, as explained above, introducing a solid-liquid mixture into a mixing container, depositing the solid component of the mixture around an opening for feeding mixture, disposed on the bottom portion of the container and feeding the mixture through the opening, it is possible to change the mixing ratio of the resultant mixture by adjusting the area of the opening for feeding. Therefore, the method according to the present invention exhibits a variety of advantages such that the construction thereof is very simple, the solid component is not damaged and destroyed and desired and constant mixing ratio can certainly be maintained.

In addition, the apparatus according to the present invention makes it possible to feed the solid component deposited around the opening for feeding together with the liquid component in a desired constant mixing ratio, this is because the apparatus according to the present invention makes it possible to adjust the mixing ratio of the mixture by simply changing the cross-section of the flow path at any positions from the opening for feeding to the chute member.

What is claimed is:

1. A method for feeding a solid-liquid mixture comprising at least one liquid component and at least one solid component having a specific gravity greater than that of the liquid component into a receiving container, comprising the steps of:

(a) providing a mixing container having a feed opening at the bottom thereof;
(b) providing a receiving container in fluid communication with the feed opening in the mixing container;
(c) introducing the solid-liquid mixture into the mixing container;
(d) allowing the solid component of the solid-liquid mixture to separate from the liquid component;
(e) depositing the separated solid component around the feed opening in the mixing container; and
(f) feeding the solid-liquid mixture through the feed opening into the receiving container.

2. The method of claim 1, wherein the receiving container is provided with means for changing the area of the feed opening and said feeding step (f) is carried out while adjusting the mixing ratio of the mixture by changing the area of the feed opening.

3. The method of claim 1, further comprising the step of providing a feeding path between the feed opening in the mixing container and the receiving container, and wherein said feeding step (f) is carried out at a constant mixing ratio which is adjusted by changing the minimum cross-section of the feeding path.

4. An apparatus for feeding a solid-liquid mixture comprising at least one liquid component and at least one solid component having a specific gravity greater than that of the liquid component in a desired and constant mixing ratio, comprising:

a mixing container having a bottom and a feed opening disposed at said bottom thereof;

a feed-controlling device disposed in the vicinity of said feed opening;

rotatable collecting means disposed in said mixing container for collecting the solid component of the mixture around said feed opening; and drive means for rotating said collecting means at a speed of sufficient slowness that the solid component of the mixture is not propelled up from said bottom of said mixing container by the rotation of said collecting means, wherein the solid component is allowed to separate from the liquid component and is deposited at said bottom of said container.

5. The apparatus of claim 4, further comprising adjustment means for changing the area of said feed opening.

6. The apparatus of claim 4, further comprising a chute member in communication with said feed opening for depositing the solid component in a receiving container.

7. The apparatus of claim 6, wherein said chute member includes an adjustment means for changing the area thereof.

8. The apparatus of claim 4, wherein said collecting device comprises a shaft and a plurality of collecting blades disposed on said shaft, said blades being positioned with respect to said shaft so as to deposit the solid component of the mixture around said feed opening.

9. The apparatus of claim 8, wherein said shaft has a longitudinal axis and each of said collecting blades being arranged on said shaft so as to make an angle with said shaft longitudinal axis of between 0° and 90° in the anti-clockwise direction with respect to said shaft longitudinal axis when observing each of said collecting blades from a position just above said shaft, assuming that said shaft is rotated in the clockwise direction when observed from the side of said feed opening and that said collecting blades are positioned just below said shaft.

10. The apparatus of claim 8, wherein said collecting blades is in the form of screws.

11. The apparatus of claim 8, wherein said collecting blades is in the form of ribbons.

12. The apparatus of claim 8, wherein said collecting blades is in the form of paddles.

13. The apparatus of claim 8, wherein said collecting blades extend throughout said mixing container except for the region just about said feed opening.

* * * * *